US007612549B1

(12) United States Patent
Kao et al.

(10) Patent No.: US 7,612,549 B1
(45) Date of Patent: Nov. 3, 2009

(54) LOW DROP-OUT REGULATOR WITH FAST CURRENT LIMIT

(75) Inventors: Shun-Hau Kao, Taipei County (TW); Mao-Chuan Chien, Taipei County (TW)

(73) Assignee: Advanced Analog Technology, Inc., Hsinchu (TW)

( * ) Notice: Subject to any disclaimer, the term of this patent is extended or adjusted under 35 U.S.C. 154(b) by 0 days.

(21) Appl. No.: 12/270,843

(22) Filed: Nov. 13, 2008

(30) Foreign Application Priority Data

Sep. 25, 2008 (TW) ..... 97136826 A

(51) Int. Cl.
*G05F 1/00* (2006.01)

(52) U.S. Cl. ..... 323/281; 323/274

(58) Field of Classification Search ..... 323/281, 323/277, 274
See application file for complete search history.

(56) References Cited

U.S. PATENT DOCUMENTS 6,246,221 B1 * 6/2001 Xi ..... 323/280
6,952,091 B2 * 10/2005 Bansal ..... 323/277
6,977,491 B1 * 12/2005 Caldwell et al. ..... 323/282

* cited by examiner

*Primary Examiner*—Shawn Riley
(74) *Attorney, Agent, or Firm*—Winston Hsu

(57) ABSTRACT

An LDO with fast current limit includes P-type transistor, an error amplifier, an adjustable reference voltage circuit for generating an adjustable reference voltage, and an N-type transistor. The P-type transistor includes a first end coupled to the input voltage source, a second end for outputting an output voltage source, and a control end for receiving a current control signal in order to control the current of the output voltage source. The error amplifier generates the current control signal according to the reference voltage and a voltage divided from the output voltage source. N-type transistor includes a first end coupled to the output end of the error amplifier, a second end coupled to the input voltage source, and a control end for receiving the adjustable reference voltage. When the N-type transistor is turned on, the voltage of the current control signal is clamped by the adjustable reference voltage.

13 Claims, 6 Drawing Sheets

LOW DROP-OUT REGULATOR WITH FAST CURRENT LIMIT

BACKGROUND OF THE INVENTION

1. Field of the Invention

The present invention relates to a Low Drop-Out (LDO) regulator, and more particularly, to an LDO regulator with fast current limit.

2. Description of the Prior Art

Please refer to FIG. 1. FIG. 1 is a diagram illustrating a conventional LDO regulator 100. As shown in FIG. 1, the LDO regulator 100 comprises a sensing resistor $R_{SEN}$, a reference resistor $R_{REF}$, two feedback resistors $R_{FB1}$ and $R_{FB2}$, a reference current source $I_{REF}$, a comparator CMP, an error amplifier EA, and a transistor $Q_1$. The transistor $Q_1$ is a P channel Metal Oxide Semiconductor (PMOS) transistor.

The LDO regulator 100 is used to convert an input voltage source $V_{IN}$ to an output voltage source $V_{OUT}$ for providing the voltage $V_{OUT}$ and the load current $I_{LOAD}$ to the load X. The detail of operation principles is explained as follows.

The feedback resistors $R_{FB1}$ and $R_{FB2}$ are coupled between the output voltage source $V_{OUT}$ and a ground end for providing a feedback voltage $V_{FB}$ divided from the output voltage $V_{OUT}$ to the error amplifier EA. The error amplifier EA comprises a positive input end for receiving the feedback voltage $V_{FB}$, a negative input end for receiving a reference voltage $V_{REF2}$, and an output end for outputting a current control signal $V_A$ according to the signals received on the positive and negative input ends of the error amplifier EA. The control end (gate) of the transistor $Q_1$ is coupled to the output end of the error amplifier EA for receiving the current control signal $V_A$. In this way, the transistor $Q_1$ controls the magnitudes of the output voltage $V_{OUT}$ and the load current $I_{LOAD}$ according to the current control signal $V_A$. More particularly, if the voltage of the current control signal $V_A$ is lower, the load current $I_{LOAD}$ is higher; if the voltage of the current control signal $V_A$ is lower, the load current $I_{LOAD}$ is higher. Consequently, when the feedback voltage $V_{FB}$ is lower than the reference voltage $V_{REF2}$ (for example, when the load current $I_{LOAD}$ drained by the load X increases), the current control signal $V_A$ generated from the error amplifier EA turns on the transistor $Q_1$ more for raising the output voltage $V_{OUT}$. That is, the voltage of the current control signal $V_A$ is decreased.

The reference resistor $R_{REF}$ is coupled between the input voltage source $V_{IN}$, the reference current source $I_{REF}$ and the positive input end of the comparator CMP for providing a reference voltage $V_{REF1}$ to the comparator CMP. The sensing resistor $R_{SEN}$ is coupled between the input voltage source $V_{IN}$ and the negative input end of the comparator CMP for providing the sensing voltage $V_{SEN}$ to the comparator CMP. The comparator CMP generates the current limit signal $S_C$ according to the comparing result of the magnitudes of the reference voltage $V_{REF1}$ between the sensing voltage $V_{SEN}$. More particularly, if the sensing voltage $V_{SEN}$ is higher than the reference voltage $V_{REF1}$, the current limit signal $S_C$ is logic "0" (low voltage level); otherwise, if the sensing voltage $V_{SEN}$ is lower than the reference voltage $V_{REF1}$, the current limit signal $S_C$ is logic "1" (high voltage level). Since the sensing resistor $R_{SEN}$ is serial-connected between the input voltage source $V_{IN}$ and the transistor $Q_1$, the magnitude of the load current $I_{LOAD}$ can be detected according to the values of the sensing voltage $V_{SEN}$ and the sensing resistor $R_{SEN}$. In this way, the load current $I_{LOAD}$ can be limited by the comparator CMP. More particularly, if the sensing voltage $V_{SEN}$ is lower than the reference voltage $V_{REF1}$, which means the load current $I_{LOAD}$ is higher than current limit $I_{LIMIT}$, the comparator CMP outputs the current limit signal with logic "1" to the error amplifier EA to disable the error amplifier EA. In other words, when the current limit signal $S_C$ is logic "1", the error amplifier EA is disabled to keep lowering the voltage of the current control signal $V_A$. In this way, the level of the transistor $Q_1$ being turning on is limited, which limits the magnitude of the load current $I_{LOAD}$.

Please refer to FIG. 2. FIG. 2 is a diagram illustrating variation of the load current of the conventional LDO regulator 100. As shown in FIG. 2, the drawback of the conventional LDO regulator 100 is that, in the conventional LDO regulator 100, detecting the load current has to execute through the conversion from the sensing resistor $R_{SEN}$ and the comparator CMP for providing the current limit control signal $S_C$. Therefore, by such mechanism for detecting the load current $I_{LOAD}$, some reaction time has to be required in order to effectively limit the load current $I_{LOAD}$. If the load current $L_{LOAD}$ increases excessively and suddenly (for example, the load X is short-circuited), the conventional LDO regulator 100 is not able to effectively and quickly limit the load current $I_{LOAD}$ so that the load current $I_{LOAD}$ is possibly higher than current limit $I_{LIMIT}$, which damages the related components.

Additionally, since the sensing resistor $R_{SEN}$ and the transistor $Q_1$ are serial-connected, consequently, the equivalent impedance between the input and the output voltage sources $V_{IN}$ and $V_{OUT}$ is increased because of the addition of the sensing resistor $R_{SEN}$, causing power waste and increasing the minimal voltage difference between the input and the output voltages of the LDO regulator 100, and thus the efficiency of the LCO regulator 100 is decreased.

SUMMARY OF THE INVENTION

The present invention provides a Low Drop-Out (LDO) regulator with fast current limit. The LDO regulator comprises a first transistor, an error amplifier, an adjustable reference voltage circuit, and a second transistor. The first transistor comprises a first end coupled to an input voltage source, a second end for outputting an output voltage source, and a control end for receiving a current control signal to control current of the output voltage source outputted from the second end of the first transistor. The error amplifier comprises a negative input end for receiving a reference voltage, a positive input end for receiving a voltage divided from the output voltage source, and an output end. The error amplifier generates the current control signal through the output end of the error amplifier according to the reference voltage and the voltage divided from the output voltage source. The adjustable reference voltage circuit is for generating an adjustable reference voltage. The second transistor comprises a first end coupled to the output end of the error amplifier, a second end, coupled to the input voltage source, and a control end coupled to the adjustable reference voltage circuit for receiving the adjustable reference voltage. When the second transistor is turned on, voltage of the current control signal is clamped by the adjustable reference voltage.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
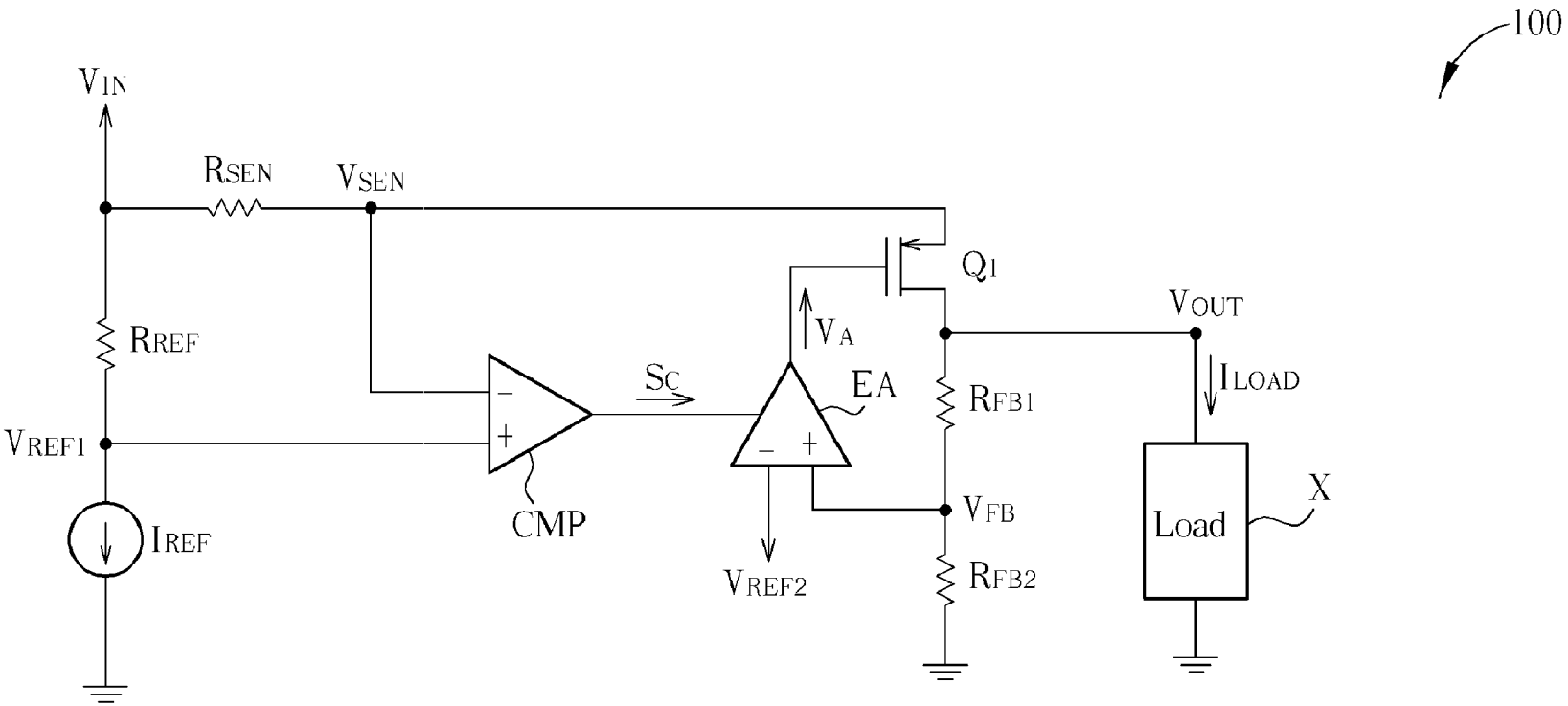
FIG. 1 PRIOR ART
FIG. 1 is a diagram illustrating a conventional LDO regulator.
Figure 2:
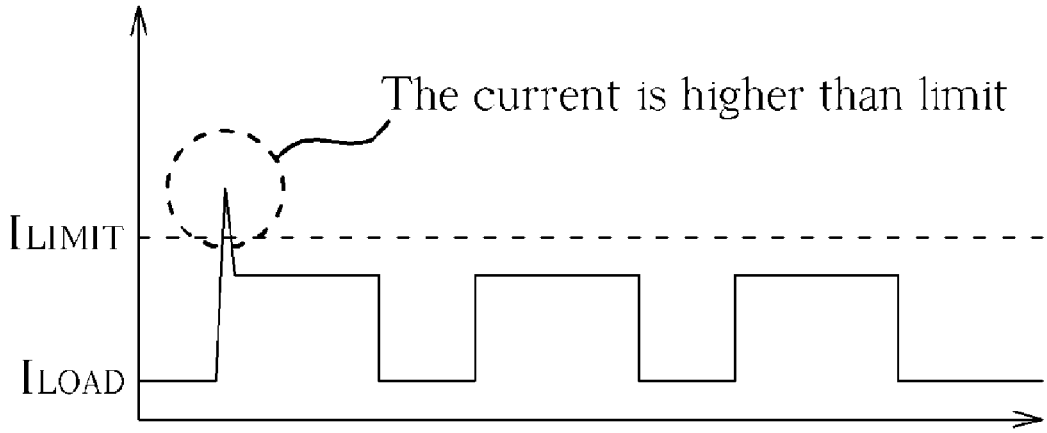
FIG. 2 PRIOR ART
FIG. 2 is a diagram illustrating variation of the load current of the conventional LDO regulator.
Figure 3:
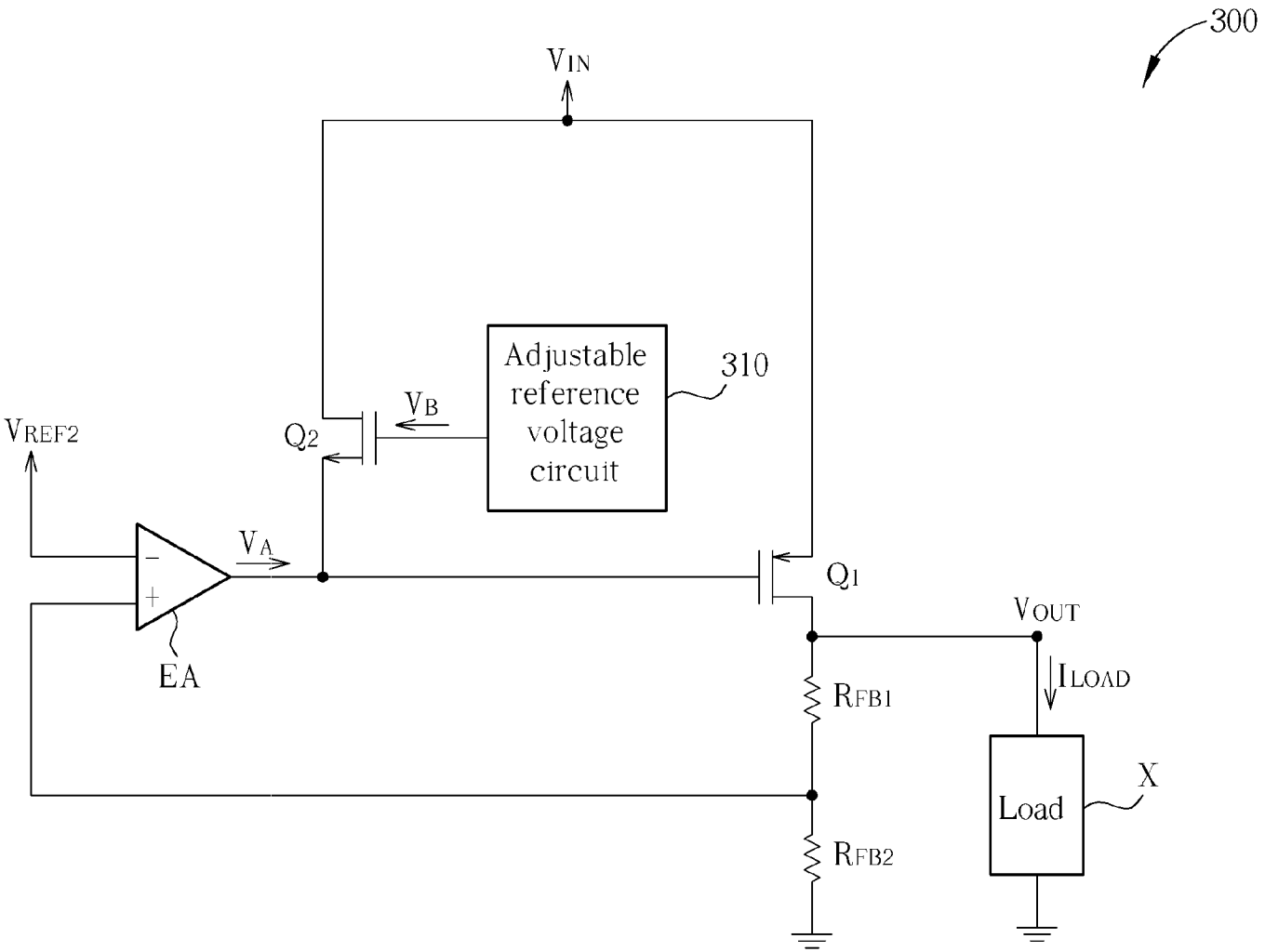
FIG. 3 is a diagram illustrating the LDO regulator with fast current limit of the present invention.

Please refer to FIG. 3. FIG. 3 is a diagram illustrating the LDO regulator 300 with fast current limit of the present invention. As shown in FIG. 3, the LDO regulator 300 comprises an error amplifier EA, two feedback resistors $R_{FB1}$ and $R_{FB2}$, two transistors $Q_1$ and $Q_2$, and an adjustable reference voltage circuit 310. The transistor $Q_1$ is a PMOS transistor, and the transistor $Q_2$ is an N channel Metal Oxide Semiconductor (NOMS) transistor.

The LDO regulator 300 is used to convert an input voltage source $V_{IN}$ to an output voltage source $V_{OUT}$ for providing the voltage $V_{OUT}$ and the load current $I_{LOAD}$ to the load X. The detail of operation principles is explained as follows.

The feedback resistor $R_{FB1}$ and $R_{FB2}$ are coupled between the output voltage source $V_{OUT}$ and a ground end for providing the feedback voltage $V_{FB}$ divided from the output voltage $V_{OUT}$ to the error amplifier EA. The error amplifier EA comprises a positive input end for receiving the feedback voltage $V_{FB}$, a negative input end for receiving a reference voltage $V_{REF2}$, and an output end for outputting current control signal $V_A$ according to the signals received on the positive and negative input ends of the error amplifier EA. The control end (gate) of the transistor $Q_1$ is coupled to the output end of the error amplifier EA for receiving the current control signal $V_A$. In this way, the transistor $Q_1$ controls the magnitudes of the output voltage $V_{OUT}$ and the load current $I_{LOAD}$ according to the current control signal $V_A$. More particularly, if the current control signal $V_A$ is lower, the load current $I_{LOAD}$ is higher; otherwise, if the current control signal $V_A$ is higher, the load current $I_{LOAD}$ is lower. Consequently, if the feedback voltage $V_{FB}$ is lower than the reference voltage $V_{REF2}$ (for example, when the load current $I_{LOAD}$ drained by the load X increases), the current control signal $V_A$ generated from the error amplifier EA turns on the transistor $Q_1$ more for raising the output voltage $V_{OUT}$. That is, the voltage of the current control signal $V_A$ is decreased.

The adjustable reference voltage circuit 310 provides an adjustable reference voltage $V_B$. The value of the adjustable reference voltage $V_B$ is adjusted according to the magnitude of the input voltage $V_{IN}$. The control end (gate) of transistor $Q_2$ is coupled to the adjustable reference voltage circuit 310 for receiving the adjustable reference voltage $V_B$; the first end (source) of the transistor $Q_2$ is coupled to the output end of the error amplifier EA; the second end (drain) of transistor $Q_2$ is coupled to the input voltage source $V_{IN}$.

In the normal operation, the transistor $Q_2$ is turned off, which means that the current control signal $V_A$ of the error amplifier EA is able to adjust the load current $I_{LOAD}$ conducted by the transistor $Q_1$ without limit. In the abnormal condition, such as the load current $I_{LOAD}$ exceeding a predetermined value (for example, when the load X is short-circuited), the transistor $Q_2$ is turned on, and thus the current control signal $V_A$ of the error amplifier EA is limited at a voltage lower than the voltage $V_B$ by a threshold voltage $V_{TH2}$, wherein the threshold voltage $V_{TH2}$ represents the threshold voltage of the transistor $Q_2$. In this way, the current control signal $V_A$ is unable to decrease further, and the magnitude of the load current $I_{LOAD}$ is effectively controlled not to be higher than current limit $I_{LIMIT}$. Besides, the adjustable reference voltage $V_B$ has to be adjusted according to the magnitude of the input voltage $V_{IN}$ for keeping the load current $I_{LOAD}$ having the same current limit as the current limit $I_{LIMIT}$ under different magnitudes of the input voltage $V_{IN}$. The detail of operation principles of the LDO regulator 300 of the present invention limiting the load current is explained as follows.

Under the condition that the load current is lower, the current control signal $V_A$ of the error amplifier EA is high enough to turn off the transistor $Q_2$. More particularly, the current control signal $V_A$ has to be not lower than the adjustable reference voltage $V_B$ by the threshold voltage $V_{TH2}$ ($V_A > V_{TH2}$) so that the current control signal $V_A$ is not affected by the transistor $Q_2$. However, when the load current $I_{LOAD}$ increases, which means the current control signal $V_A$ decreases, once the voltage of the current control signal $V_A$ is lower than the adjustable reference voltage $V_B$ by the threshold voltage $V_{TH2}$, the transistor $Q_2$ is turn on, and the voltage of current control signal $V_A$ is clamped at a voltage lower than the adjustable reference voltage $V_B$ by the threshold voltage $V_{TH2}$. In other word, by the clamping mechanism of the transistor $Q_2$ of the present invention, the voltage of the current control signal $V_A$ is never lower than the adjustable reference voltage $V_B$ by the threshold voltage $V_{TH2}$. In this way, the load current $I_{LOAD}$ outputted from the transistor $Q_1$ does not exceed the current limit $I_{LIMIT}$ even for a very short moment. Therefore, the problem of the related components damaged by the sudden large current can be solved.

Additionally, the magnitude of the adjustable reference voltage $V_B$ is used to set the magnitude of the current limit $I_{LIMIT}$.

Figure 4:
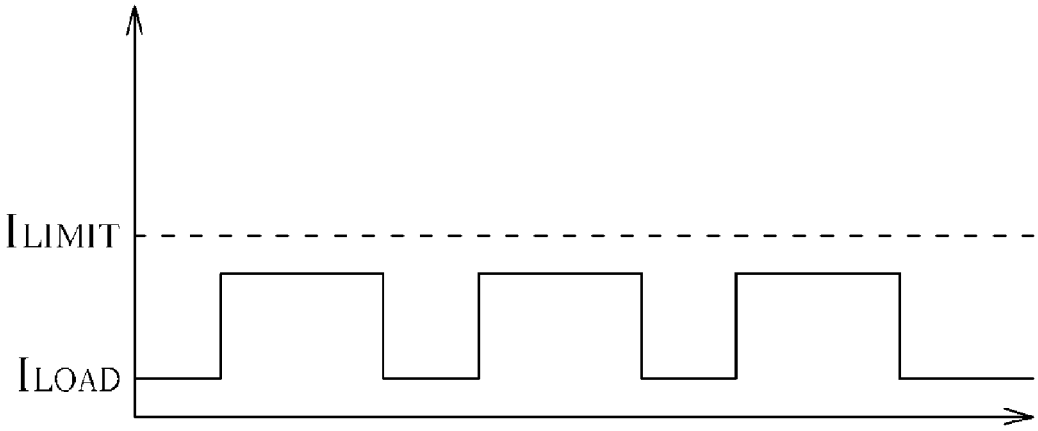
FIG. 4 is a diagram illustrating the variation of the load current of the LDO regulator with fast current limit of the present invention.

Please refer to FIG. 4. FIG. 4 is a diagram illustrating the variation of the load current of the LDO regulator 300 with fast current limit of the present invention. As shown in FIG. 4, because of the adjustable reference voltage circuit 310 and the transistor $Q_2$, the load current $I_{LOAD}$ is not higher than the current limit $I_{LIMIT}$ even if the load X is short-circuited, which avoids the damage of the related components.

Furthermore, since the LDO regulator 300 of the present invention does not dispose a sensing resistor between the input voltage source $V_{IN}$ and the transistor $Q_1$, consequently, the equivalent resistance of the LDO regulator between the input voltage source $V_{IN}$ and the transistor $Q_1$ is lower than that of the conventional LDO regulator. Therefore, the power waste between the input voltage source $V_{IN}$ and the transistor $Q_1$ is reduced, and the minimal voltage drop between the input voltage source $V_{IN}$ and the transistor $Q_1$ is reduced as well, and thus the efficiency of the LCO regulator 300 of the present invention is increased.

Figure 5:
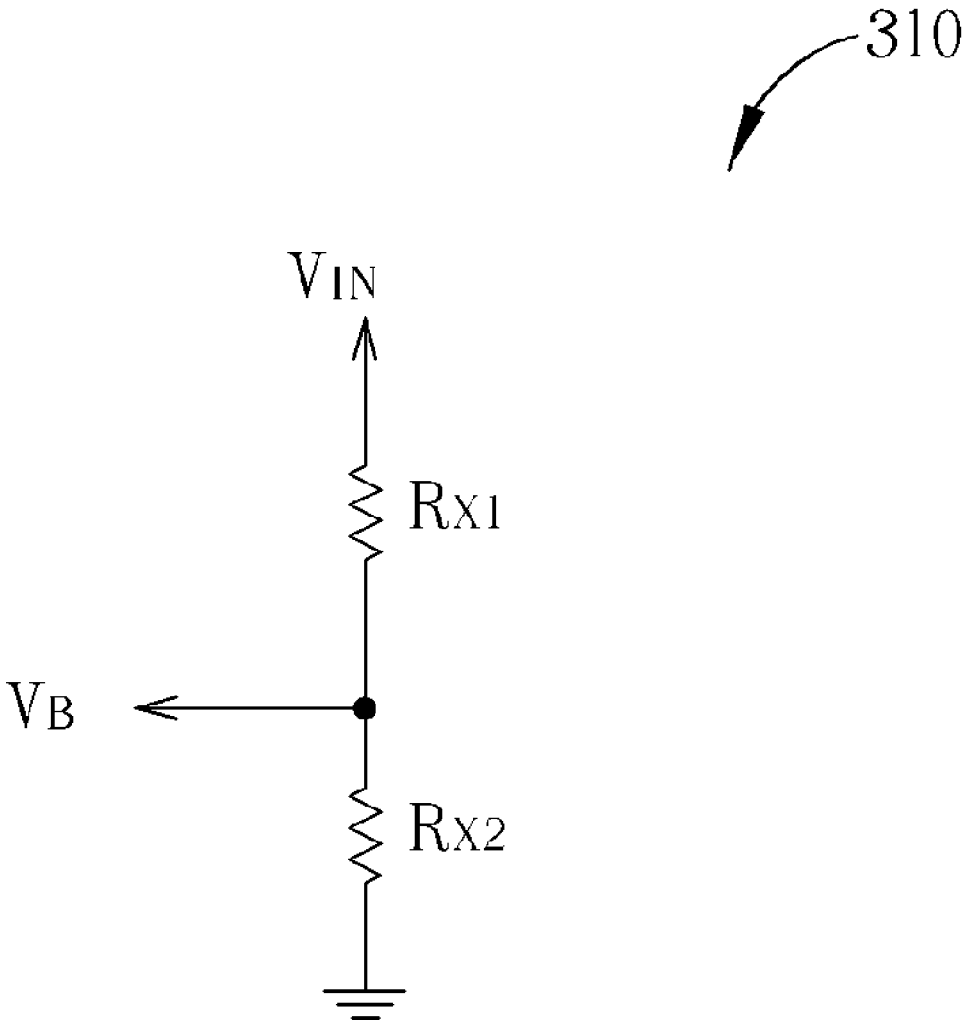
FIG. 5 is a diagram illustrating the adjustable reference voltage circuit according to a first embodiment of the present invention.

Please refer to FIG. 5. FIG. 5 is a diagram illustrating the adjustable reference voltage circuit 310 according to a first embodiment of the present invention. As shown in FIG. 5, the adjustable reference voltage circuit 310 comprises two dividing resistors $R_{X1}$ and $R_{X2}$. The dividing resistors $R_{X1}$ and $R_{X2}$ are serial-coupled between the input voltage source $V_{IN}$ and the ground end. The adjustable reference voltage $V_B$ is a voltage divided from the input voltage source $V_{IN}$ according to the resistances of the resistors $R_{X1}$ and $R_{X2}$. More particularly, the adjustable reference voltage $V_B$ is the voltage on the dividing resistor $R_{X2}$. As shown in FIG. 5, if the input voltage source $V_{IN}$ is higher, the adjustable reference voltage $V_B$ is higher; otherwise, if the input voltage source $V_{IN}$ is lower, the adjustable reference voltage $V_B$ is lower. In this way, the adjustable reference voltage $V_B$ is able to dynamically change in accordance with the input voltage source $V_{IN}$, which allows the range of the limit of the current control signal $V_A$ to change as well for controlling the current limit $I_{LIMIT}$ at a fixed value.

Figure 6:
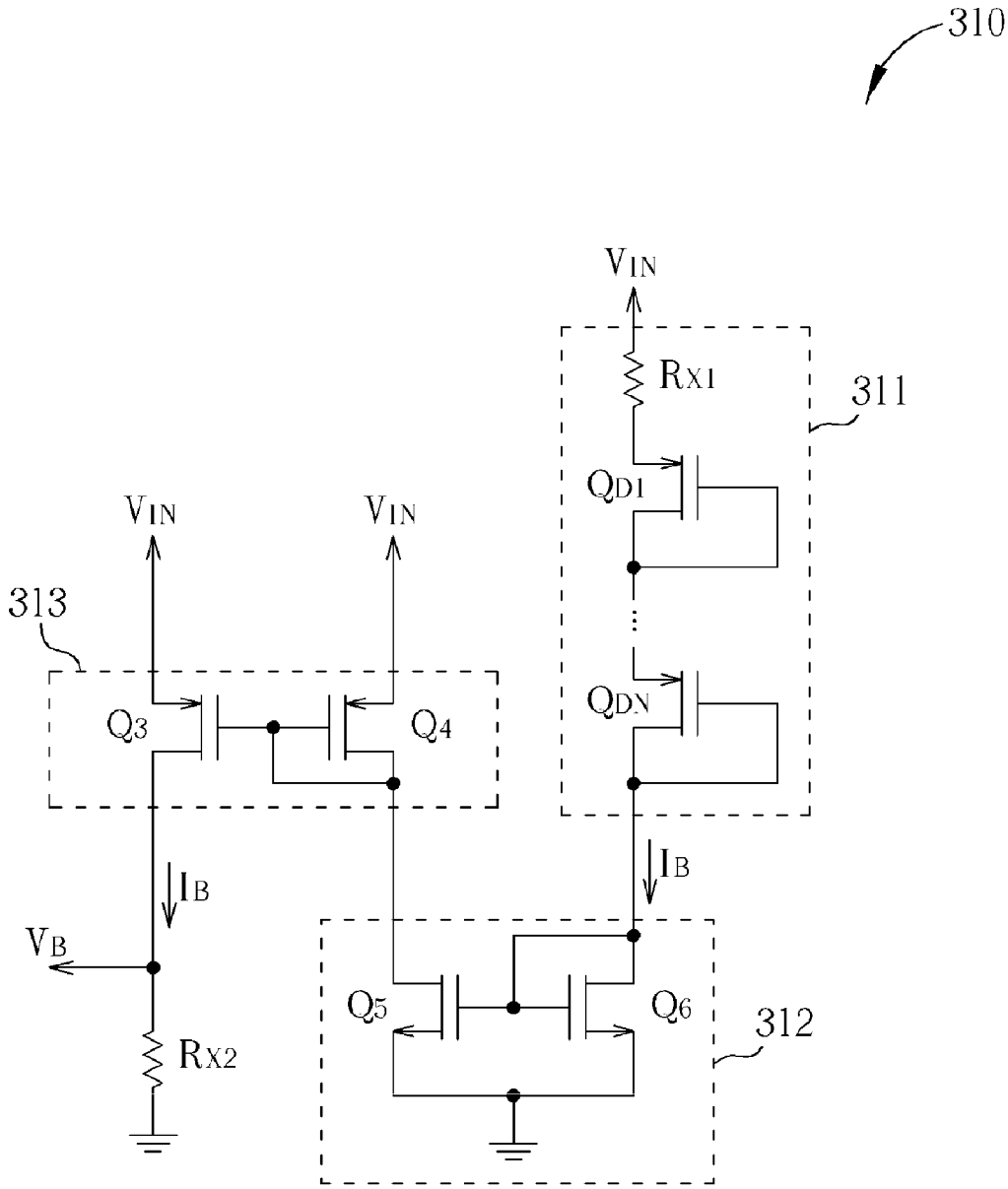
FIG. 6 is a diagram illustrating the adjustable reference voltage circuit according to a second embodiment of the present invention.

Please refer to FIG. 6. FIG. 6 is a diagram illustrating the adjustable reference voltage circuit 310 according to a second embodiment of the present invention. As shown in FIG. 6, the adjustable reference voltage circuit 310 comprises an impedance circuit 311, a first current mirror 312, a second mirror 313, and a resistor $R_{X2}$. The voltage on the resistor $R_{X2}$ is served as the adjustable reference voltage $V_B$. The impedance circuit 311 comprises a resistor $R_{X1}$, and N transistors $Q_{D1}$~$Q_{DN}$. The drain and the gate of each of the N transistors $Q_{D1}$~$Q_{DN}$ are coupled together to form a diode, and therefore, the N transistors $Q_{D1}$~$Q_{DN}$ can be seen as a plurality of diodes connected in series. The impedance circuit 311 is coupled between the input voltage source $V_{IN}$ and the first current mirror 312, where the reference current $I_B$ passes. The first current mirror 312 comprises the transistors $Q_5$ and $Q_6$ for replicating the reference current $I_B$ to the second mirror 313. The second mirror 313 comprises the transistors $Q_3$ and $Q_4$ for replicating the reference current $I_B$ again and providing to the resistor $R_{X2}$. In this way, the adjustable reference voltage $V_B$ is generated on the resistor $R_{X2}$ ($V_B=R_{X2}\times I_B$). As shown in FIG. 6, if the input voltage $V_{IN}$ increases, the current $I_B$ increases, and the adjustable reference voltage $V_B$ increases; otherwise, if the input voltage source $V_{IN}$ decreases, the current $I_B$ decreases, and the adjustable reference voltage $V_B$ decreases. In this way, the adjustable reference voltage $V_B$ is able to dynamically change in accordance with the input voltage $V_{IN}$, which allows the range of the limit of the current control signal $V_A$ to change as well for controlling the current limit $I_{LIMIT}$ at a fixed value.

To sum up, the LDO regulator provided by the present invention limits the load current to be not higher than current limit fast and effectively, and reduces the power waste between the input and output voltage sources of the LDO regulator, which decreases the rising temperature caused by the power waste of the LDO regulator, providing great convenience.

Those skilled in the art will readily observe that numerous modifications and alterations of the device and method may be made while retaining the teachings of the invention.

What is claimed is:

1. A Low Drop-Out (LDO) regulator with fast current limit, comprising:

a first transistor, comprising:

a first end, coupled to an input voltage source;

a second end for outputting an output voltage source; and a control end for receiving a current control signal to control current of the output voltage source outputted from the second end of the first transistor;

an error amplifier, comprising:

a negative input end for receiving a reference voltage;

a positive input end for receiving a voltage divided from the output voltage source; and an output end, the error amplifier generating the current control signal through the output end of the error amplifier according to the reference voltage and the voltage divided from the output voltage source;

an adjustable reference voltage circuit for generating an adjustable reference voltage; and a second transistor, comprising:

a first end, coupled to the output end of the error amplifier;

a second end, coupled to the input voltage source; and a control end, coupled to the adjustable reference voltage circuit for receiving the adjustable reference voltage;

wherein when the second transistor is turned on, voltage of the current control signal is clamped by the adjustable reference voltage.

2. The LDO regulator of claim 1, further comprising:

a first resistor, coupled to the output voltage source; and a second resistor, coupled between the first resistor and a ground end, and coupled to the positive input end of the error amplifier for providing a voltage divided from the output voltage source.

3. The LDO regulator of claim 1, wherein when the voltage of the current control signal is lower, current of the output voltage source outputted from the first transistor is higher; when the voltage of the current control signal is higher, the current of the output voltage source outputted from the first transistor is lower.

4. The LDO regulator of claim 1, wherein the second transistor is turned on when the voltage of the current control signal is lower than a predetermined value.

5. The LDO regulator of claim 4, wherein the second transistor is turned on according to a following equation:

$$V_A \leqq (V_B - V_{TH});$$

wherein $V_A$ represents the voltage of the current control signal, $V_B$ represents the adjustable reference voltage, and $V_{TH}$ represents threshold voltage of the second transistor.

6. The LDO regulator of claim 5, wherein when the second transistor is turned on, the voltage of the current control signal is cramped at $V_B-V_{TH}$.

7. The LDO regulator of claim 1, wherein the first transistor is a P channel Metal Oxide Semiconductor (PMOS) transistor and the second transistor is an N channel Metal Oxide Semiconductor (NMOS) transistor.

8. The LDO regulator of claim 1, wherein the adjustable reference voltage outputted from the adjustable reference voltage circuit is adjusted according to a voltage of the input voltage source.

9. The LDO regulator of claim 8, wherein the adjustable reference voltage comprises:

a first resistor, coupled to the input voltage source; and a second resistor, coupled between the first resistor and a ground end, and coupled to the control end of the second transistor;

wherein a voltage on the second resistor is served as the adjustable reference voltage.

10. The LDO regulator of claim 8, wherein the adjustable reference voltage circuit comprises:

an impedance circuit, coupled to the input voltage source for generating a reference current accordingly;

a first current mirror, coupled to the impedance circuit for replicating the reference current and outputting the replicated reference current;

a second current mirror, coupled to the first current mirror for replicating the reference current again and outputting the replicated reference current; and a third resistor, coupled to the second current mirror, for receiving the replicated reference current, and generating the adjustable reference voltage accordingly.

11. The LDO regulator of claim 10, wherein the impedance circuit comprises:

a fourth resistor, coupled to the input voltage source; and a plurality of transistors connected in series, coupled between the fourth resistor and the first current mirror;

wherein a first end of each of the plurality of the transistors is coupled to a control end of a corresponding transistor of the plurality of the transistors in order to be utilized as a diode.

12. The LDO regulator of claim 11, wherein the first current mirror comprises:

a third transistor, comprises:

a first end, coupled to the plurality of the transistors connected in series;

a second end, coupled to a ground end; and a control end, coupled to the first end of the third transistor; and a fourth transistor, comprises:

a first end for outputting the replicated reference current;

a second end, coupled to the ground end; and a control end, coupled to the first end of the third transistor.

13. The LDO regulator of claim 12, wherein the second current mirror comprises:

a fifth transistor, comprises:

a first end, coupled to the input voltage source;

a second end, coupled to the first end of the fourth transistor; and a control end, coupled to the first end of the fourth transistor; and a sixth transistor, comprises:

a first end, coupled to the third resistor, for outputting the replicated reference current in order to generate the adjustable reference voltage;

a second end, coupled to the input voltage source; and a control end, coupled to the first end of the fourth transistor.

* * * * *